US005458168A

United States Patent [19]

Lindgren

[11] Patent Number: 5,458,168

[45] Date of Patent: Oct. 17, 1995

[54] SELF-CLOSING FUNNEL

[75] Inventor: Mats Lindgren, Vikmanshyttan, Sweden

[73] Assignee: AB Kompositprodukter S.K.-F.M., Vikmanshyttan, Sweden

[21] Appl. No.: 256,543

[22] PCT Filed: Jan. 12, 1993

[86] PCT No.: PCT/SE93/00013

§ 371 Date: Jul. 13, 1994

§ 102(e) Date: Jul. 13, 1994

[87] PCT Pub. No.: WO93/14020

PCT Pub. Date: Jul. 22, 1993

[30] Foreign Application Priority Data

Jan. 20, 1992 [SE] Sweden ..... 9200150

[51] Int. Cl.[6] ..... B65B 1/30; B65B 3/28

[52] U.S. Cl. ..... 141/199; 141/DIG. 1; 141/203; 141/204; 141/300; 141/343

[58] Field of Search ..... 141/DIG. 1, 199, 141/200, 201, 202, 203, 204, 205, 297, 298, 299, 300, 340, 341, 342, 343, 367, 375

[56] References Cited

U.S. PATENT DOCUMENTS

| | | | |
|---|---|---|---|
| 357,476 | 2/1887 | Gersdorff | 141/297 |
| 493,993 | 3/1893 | Gaudron | 141/199 X |
| 493,994 | 3/1893 | Gaudron . | |
| 615,337 | 12/1898 | Atshul | 141/201 |
| 1,023,012 | 4/1912 | Gilbert | 141/200 |
| 1,293,575 | 2/1919 | Tapman | 141/200 |
| 1,486,078 | 3/1924 | Dumont | 141/204 |
| 1,664,266 | 3/1928 | Del Rio | 141/204 |
| 2,715,488 | 8/1955 | Conlon . | |
| 3,123,106 | 3/1964 | Parhaniemi | 141/204 |
| 3,763,903 | 10/1973 | Ouchterlony | 141/201 |
| 4,712,595 | 12/1987 | Wilson . | |
| 4,804,026 | 2/1989 | Bailey | 141/340 |
| 5,277,233 | 1/1994 | Fleming | 141/201 |

FOREIGN PATENT DOCUMENTS

| | | | |
|---|---|---|---|
| 705440 | 6/1931 | France | 141/203 |
| 2606855 | 5/1988 | France . | |
| 2610305 | 8/1988 | France . | |
| 348251 | 2/1922 | Germany . | |
| 894213 | 5/1954 | Germany . | |
| 1375560 | 2/1988 | U.S.S.R. | 141/DIG. 1 |

OTHER PUBLICATIONS

Derwent, Abstract of SU 1375–560–A, A. K. Podelets, Feb. 23, 1988.

*Primary Examiner*—Henry J. Recla
*Assistant Examiner*—Steven O. Douglas
*Attorney, Agent, or Firm*—Sughrue, Mion, Zinn, Macpeak and Seas

[57] ABSTRACT

A self-closing funnel includes a downwardly narrowing flow-receiving part 1, a tubular spout 2 extending from the receiving part, and a float 5 which is movable within the spout. The funnel further includes a float-control valve 11, 12 and a permanent magnet 10 which influences the closing movement of the valve. The funnel includes a spring 9 which in the active state of the float counterbalances an essential part of its intrinsic weight, and a constriction 11 provided upstream of the float is configured so that the flow area 8 through the construction is smaller than the flow area between the spout and the float.

10 Claims, 2 Drawing Sheets

SELF-CLOSING FUNNEL

BACKGROUND OF THE INVENTION

The present invention relates to a self-closing funnel of the kind which includes a downwardly narrowing flow receiving or catching part, a tubular flow directing spout which extends down from the flow receiving part, a float which is movably mounted in the spout, at least one through-flow chamber which is defined between the float and the spout, a float-controlled valve means, and a permanent magnet which influences the closing action of the valve means.

Self-closing funnels, i.e. funnels in which the flow of medium is cut off when a given level is reached in the container filled with the aid of the funnel, have earlier been proposed with the intention of simplifying container-filling procedures, e.g the filling of a gasoline or petrol tank from a gasoline or petrol can.

A funnel of the aforesaid kind is known from U.S. Pat. No. 4,712,595. This known funnel includes a float which is placed in the funnel spout and a float-controlled valve means mounted upstream of the spout. The valve means includes a permanent magnet which, when the valve has been closed as a result of the float moving into contact therewith, functions to hold the valve closed, therewith enabling any liquid remaining in the funnel to be poured back into a can or some corresponding receptacle.

Particular demands are placed on funnels of this kind when they are to be used to fill the fuel tanks of, for instance, small internal combustion engines used, for instance, to power lawn mowers, chain saws and similar tools in which the filling opening of the fuel tank may be very small and the tank may have the form of a flat container of small vertical extension or height, which means that it must be possible to fill the tank to an exact level precisely beneath the filling opening. If this were not possible, a relatively large part of the tank volume would remain unfilled or the tank would be overfilled.

In the case of small tank openings, it is essential that the float be prevented from engaging the rim of the filling hole as the spout is withdrawn from the tank and therewith unintentionally opening the valve. This requires that the float is arranged inside the spout which means that the float will have a very small cross-sectional area, since it must leave enough space between the outer surface of the float and the spout wall for liquid to flow through the spout. A float of small cross-sectional area will unavoidably exert a low dynamic upward force or lifting force. This may result in problems in achieving positive closing of the valve, unless floats of impractical lengths are used, and also in difficulties of always closing the valve at essentially the same liquid level in the tank.

The present invention is based on the realization that these problems can be solved when a greater part of the intrinsic weight of the float arrangement is balanced or compensated for with the aid of a spring, and when the float is arranged so that it will not be influenced by varying static pressures caused, among other things, by varying levels of liquid in the funnel.

U.S. Pat. No. 1,293,575 and DE-C 894,213 teach two closable funnels provided with spring means. These springs, however, are not used to balance out the intrinsic weight of the float but are used to ensure that the float will close the valve in the manner intended. In this case, the float action is utilized solely to release the force stored in the spring that is used to effect the valve closing movement. Furthermore, the floats taught by these prior publications are mounted below the spout, which is disadvantageous from several aspects.

Although the float of the earlier mentioned U.S. Pat. No. 4,712,595 is mounted in the spout, the float will close the valve means at different liquid levels in the container in dependence on the prevailing level of liquid in the funnel. This is because the bottom end of the spout is provided with a guide which has only a few small openings, whereas the valve opening surrounding the operating rod has a wide area. Thus, as will also be when the funnel is used, a column of liquid will be formed in the funnel, above the lower guide means. The float will therefore be subjected to varying hydrostatic pressures which correspond to the height of the liquid in the funnel. This means that the valve closing movement will be initiated at different levels in the container, since the requisite dynamic upward force will vary in dependence on the height of the liquid column.

This also applies to the funnels taught by U.S. Pat. No. 2,715,488, DE-C 348,251, FR-A1 2,606,855 and 2,610,305.

The publications SU-A11,375,560 and U.S. Pat. No. 493,994 teach other variants of self-closing funnels in which the respective floats are mounted in protective housings in the spout. This arrangement renders the funnels more complicated, more expensive and more space consuming. The weight of the float is not compensated for in the funnels structures taught by these earlier publications.

SUMMARY OF THE INVENTION

In order, among other things, to eliminate the aforesaid drawbacks of known self-closing funnels, a funnel of the kind defined in the first paragraph of this specification is, in accordance with the invention, characterized in that it includes a spring which in the active valve-closing state of the float compensates or balances out an essential part of the intrinsic weight of the float; and in that the funnel includes a constriction which is located upstream of the float, so that the flow area past the constriction will be smaller than the flow area of the chamber that is defined between the float and the spout wall.

A funnel of this construction can be provided with a very narrow spout without needing to give the spout an impractical length, and the valve will always close at essentially the same level of liquid in the container as the container is filled. Furthermore, no extra volume of liquid will remain in the spout when the valve is closed, this liquid otherwise being liable to overfill the container or to run down along the outer surfaces thereof.

In order to eliminate the risk of the valve means being closed unintentionally during a filling operation, it is preferred that at least one air hole is provided in the spout, between the constriction and the float.

In order to further ensure that the valve means will always close at essentially the same liquid level in the container, the spout of the funnel is conveniently provided with at least one opening in the part thereof which surrounds the float, this opening being located on a higher level than the opening that corresponds to the desired container filling level.

According to one embodiment of the funnel, the constriction may have the form of a bottom member mounted in the receiving part of the funnel and having a flow-restricting throughflow opening which may be covered by the float so as to close the funnel. In this case, the float is conveniently provided with an operating rod which projects up through said opening, and the compensating spring may be fitted around the rod. The permanent magnet may either form part of or be mounted on the aforesaid bottom member in the flow receiving part of the funnel or form part of or be mounted on the upper part of the float, wherein the other part may consist of or be provided with a body of magnetically attractable material.

For the purpose of simplifying manufacture and of making manufacture less expensive, the float will preferably have the form of an elongated cylinder which is open at its bottom end. The float may have a polygonal cross-section and therewith be guided by direct contact with the inner wall of the spout. Alternatively, the float may have a circular cross-section and the outer wall and/or the inner spout wall provided with float-guiding projections.

The funnel is also conveniently provided with an external stop means which limits the depth to which the spout can be inserted into the container to be filled and which therewith also determines the level to which the container is filled.

BRIEF DESCRIPTION OF THE DRAWINGS

The invention will now be described in more detail with reference to the accompanying drawings.

DETAILED DESCRIPTION OF THE PREFERRED EMBODIMENTS

Figure 1:
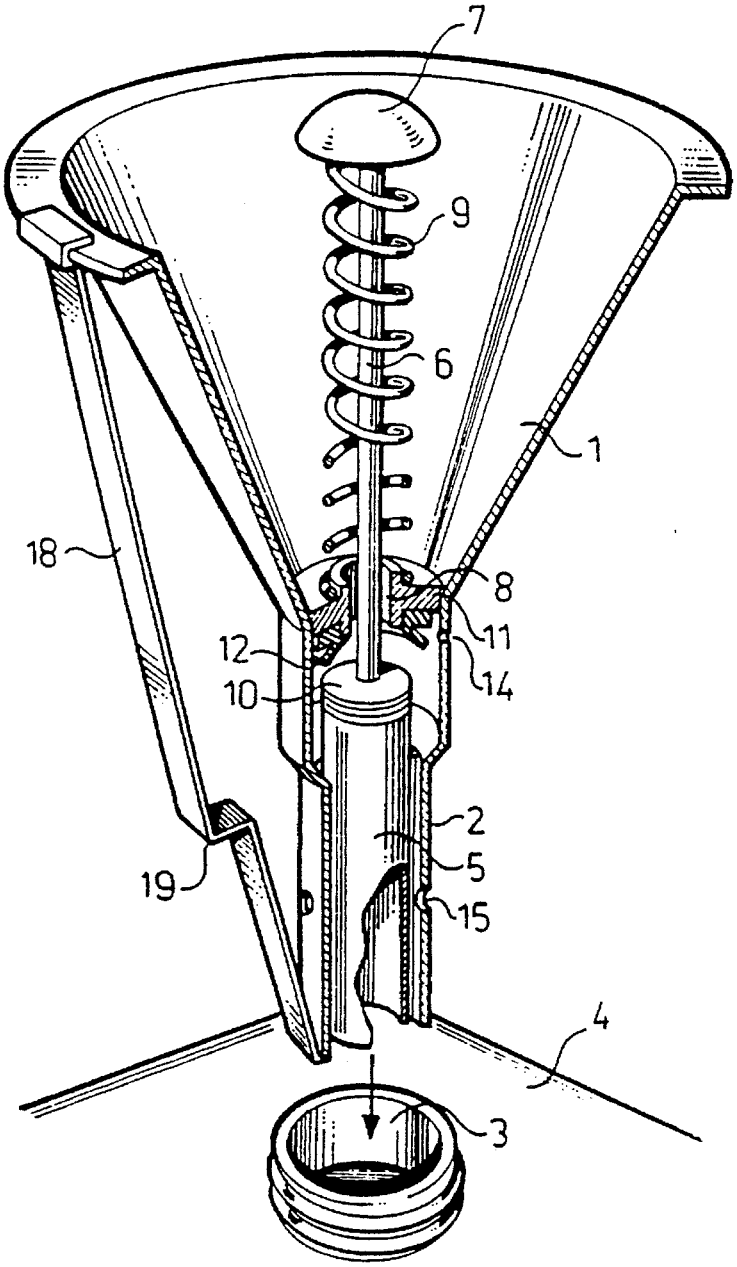
FIG. 1 illustrates an inventive funnel in perspective and partly in section.

In FIG. 1, the reference numeral 1 identifies the conical receiving part of the funnel, while the reference numeral 2 identifies the spout of the funnel which is intended to be inserted into a filling opening 3 of, for instance, a gasoline or petrol tank 4. Movably arranged in the spout 2 is an elongated cylindrical float 5. The bottom end of the float is open, which simplifies manufacture and also eliminates problems which are otherwise likely to occur in conjunction with liquid leaking into a float which was initially liquid-tight or impervious. The float 5 is provided with an upwardly extending operating rod 6 having a head 7. The rod extends up through a central opening 8 in a bottom member 11 provided in the conical part 1, and a pressure spring 9 is mounted between the bottom member and the head 7 of said rod. The clearance between the rod 6 and the wall of the central opening 8 constitutes a flow constriction, described below.

The diameter of the tank filling hole 3 may be as small as 25–35 mm, and consequently the diameter of the float will also be very small, perhaps smaller than 20 mm. The upward dynamic force is also very small, in the order of 15 g. The float must therefore be made as light as possible, although it must be given a length which provides the requisite lifting force. An essential part of the intrinsic mass of the float system is counterbalanced with the aid of the spring 9. In order to function effectively, the intrinsic mass of the float system must be in suitable relationship with the dynamic lifting force. Successful tests have been carried out with float systems having a maximum intrinsic mass of three times the lifting force, e.g. 3×15 g. The spring should therefore compensate for about 35–40 g in order for the float to function effectively.

The upper end of the float carries a permanent magnet 10 and the bottom member 11 is comprised of a soft-magnetic material which is attracted by the permanent magnet. The magnet 10 is dimensioned so that as soon as the float 5 has been raised through an initial short distance, the magnetic force will be sufficient to draw the float up into contact with the bottom member 11 and therewith effectively close the center opening 8 in said member. Reference numeral 12 identifies a ring-shaped seal which coacts with the upper end of the float. The float, the sealing ring and the opening 8 in the bottom member 11 thus form a valve means which when closed is held in its closed state by the permanent magnet 10, so as to retain surplus liquid in the conical part 1. This surplus liquid can then be returned to the can used to fill the tank 4, the spout 2 being inserted into the can and the rod 6 being pressed downwards with the aid of the head 7 so as to reopen the valve. The valve will then remain open until the funnel is again used in its container filling capacity.

Figure 2:
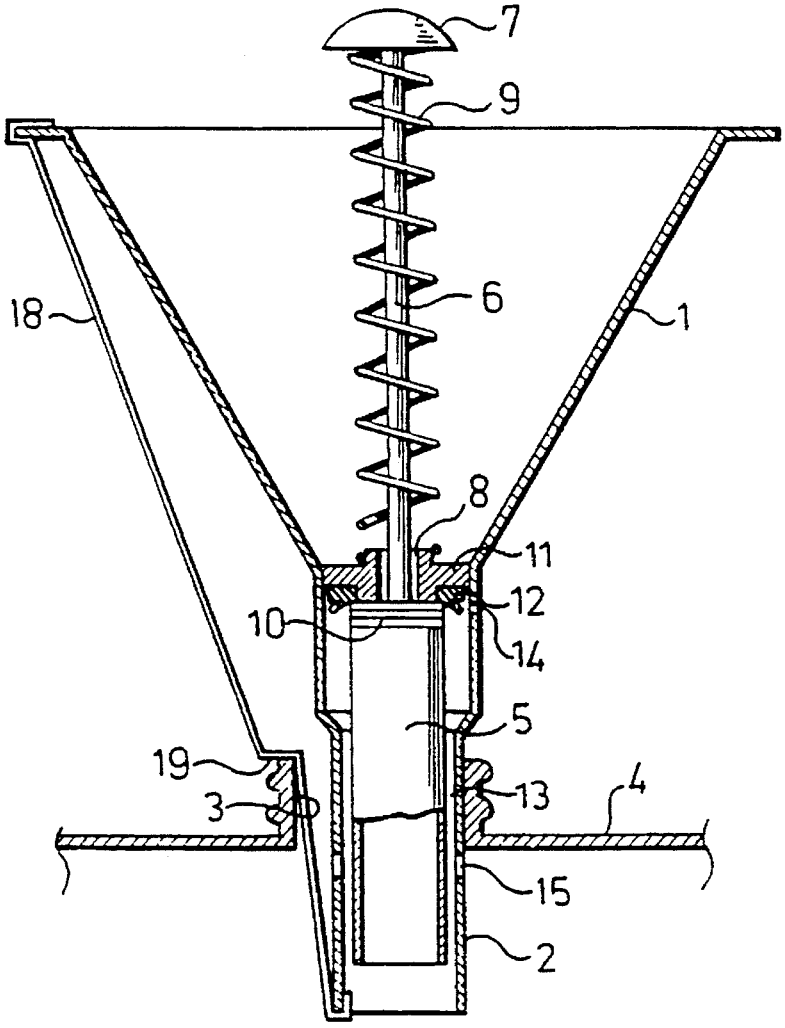
FIG. 2 is a side view of the funnel shown in FIG. 1 partly in section and shows the funnel inserted into a container.

The aforedescribed funnel arrangement may also be used as a metering device, for instance when mixing a desired quantity of oil with the gasoline present in a tank. In this case, the valve is held closed with the aid of the rod 6 and oil is poured into the conical part of the funnel up to a level mark (not shown), whereafter the valve is reopened to allow the oil to pass into the tank. FIG. 2 illustrates the funnel inserted into the tank 4, with the valve closed, i.e. the tank is filled to the desired level. In order for the valve to always close at the same level of liquid in the tank irrespective of the amount of liquid present in the funnel cone, it is important that the liquid in the funnel will not form a liquid column that acts on the float. Consequently, it is essential that the throughflow area of the center opening 8 around the rod 6 is smaller than the liquid throughflow area defined between the float 5 and the inner wall of the spout 2. This latter throughflow area is suitably at least about twice the first-mentioned throughflow area. This will ensure that all liquid running through the centre opening 8 will have time to pass-out through the spout without being retarded to form a continuous liquid column. In the case of this embodiment, this is achieved by the constriction represented by the centre opening 8.

As the liquid flows down through the annular chamber 13 around the float 5, it is possible that air will be entrained with the liquid in an amount sufficient to form a subpressure on the upper side of the float and therewith result in unintentional closure of the valve or at least in premature closing of said valve. This possibility can be eliminated in accordance with the present invention by providing at least one air hole 14 in the spout downstream of the bottom member 11 but above the float 5. The air hole 14 should be sufficiently small to eliminate the risk of liquid flowing out through the hole, e.g. should have a diameter in the order of 1–2 mm.

Tests have shown that an advantage is gained when at least one and preferably a ring of penetrating holes 15 is/are provided in that part of the spout 2 which surrounds the float 5. These holes 15 will preferably be located at a higher level than the liquid level in the tank at which the valve means shall be closed. It has been established that the provision of such holes will always ensure that the valve is closed at essentially the same level of liquid in the tank, with very small variations. This is important because, for instance, a variation of ±6 mm in a tank having a total vertical extension of 60 mm can be said to correspond to ±10% of the tank volume. A greater variation than this should not be accepted.

It is assumed that the effect of the holes 15 is to prevent the occurrence of an overpressure in the space around and above the float 5, when the level of liquid in the tank reaches and covers the bottom open end of the spout 2. This overpressure would otherwise probably occur as a result of the air entrained by the liquid flow being prevented from passing out through the spout with the liquid. This problem could possibly be alleviated by making the hole 14 larger, although this solution would involve the risk of liquid running onto the outer surfaces of the tank. Irrespective of whether the aforesaid theoretical explanation of the functional effect of the holes 15 is correct or not, tests carried out in practice have verified that the provision of the holes 15 has the effect of greatly reducing variations in the valve closing level.

As will be understood, the aforesaid holes may be replaced with slots. From the aspect of manufacture, it is more advantageous to provide the spout with slots which extend axially from the bottom end of the spout up to a level above the desired valve closing level. In this case, the bottom of the spout will suitably be closed.

No separate guides of the usual kind are required with an elongated float of the type used in accordance with the invention, the float being movable in a narrow-bore spout, since the float can be readily guided by direct contact with the spout wall.

Figure 3:
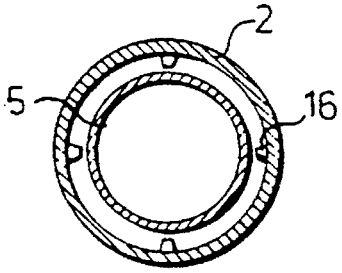
FIGS. 3 and 4 are cross-sectional views of two different float embodiments.

FIG. 3 is a sectional view of the spout 2 and a float 5 of circular cross-section. In this embodiment the float can be guided as it moves in the spout by means of axially extending ribs 16 mounted on either the float or on the inner wall of the spout.

Figure 4:
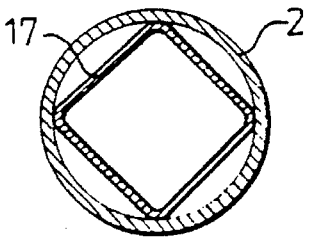

FIG. 4 is a cross-sectional view of an embodiment which lacks the provision of separate guide means. In this case, the float 17 has a square cross-section with the corners of the square in immediate guiding contact with the inner surface of the spout. Naturally, other cross-sectional shapes can be used, for instance some other equilateral polygonal shape.

In order to enable the funnel to be held firmly in position in tank-filling openings of widely varying diameters, the funnel illustrated in FIG. 1 is provided with an outer handle 18, for instance in the form of a flexible steel strap, which extends between the upper and the lower ends of the funnel. The strap has a pronounced knee 19 which determines the extent to which the spout 2 can be inserted into the tank 4, and therewith also determines the level to which the tank is filled. Different handles 18 can be used to determine different filling levels.

Figure 5:
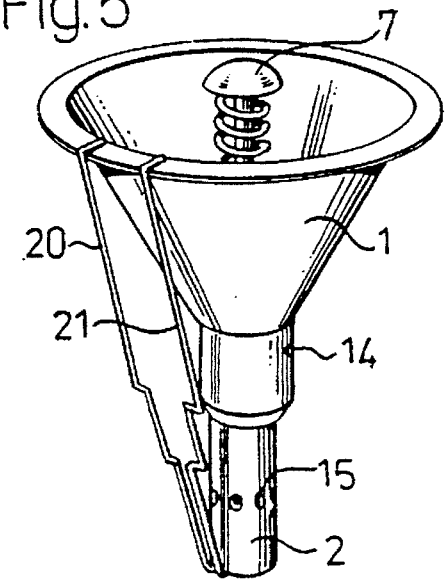
FIG. 5 illustrates another embodiment of funnel securing means.

FIG. 5 illustrates an alternative embodiment in which the aforesaid resilient steel band is replaced with two piano wires 20 and 21, each of which has two knees, as shown in the Figure. Thus, with this embodiment, the level to which the tank is filled can be lowered from the level represented by the bottom knees to the level represented by the top knees, by pressing the wires 20 and 21 together while, at the same time, pressing the funnel down to a greater extent in the tank filling hole. The funnel will be held firmly in both of these positions, while maintaining an air passage between the outer surface of the spout and the defining wall of the filling opening.

Although the invention has been described above with reference to preferred embodiments thereof, it will be understood that the invention is not limited to these embodiments and that modifications and changes can be made within the scope of the following claims. For instance, the arrangement comprising the counterbalancing spring, the configuration of the float and also the nozzle-fixing handle can be varied as desired. The handle may also be excluded. The positioning and configuration of the permanent magnet can also be changed.

I claim:

1. A self-closing funnel for filling fluids into a container, comprising: a downwardly narrowing flow-receiving part (1), a tubular spout (2) extending from said flow-receiving part, a float (5) movable within the spout in response to fluid therein, at least one throughflow chamber (13) defined by the space between the float and the spout, valve means (11, 12), in said spout responsive to movement of said float for preventing flow through said spout when a predetermined fluid level is reached a permanent magnet (10) in said funnel for influencing closing of said valve means and a spring (9) retained within said flow receiving part counterbalancing for the intrinsic weight of the float to render the flat more responsive; wherein the funnel further includes a liquid flow constriction disposed upstream of the float and dimensioned such that the flow area for passage of liquid through the constriction is smaller than a smallest fluid flow area downstream of the constriction.

2. A funnel according to claim 1, further comprising at least one air hole (14) provided in the spout (2) between the constriction and the float (5).

3. A funnel according to claim 1, wherein a part of the spout (2) which surrounds the float (5) has at least one opening (15) located at a higher level than a level which corresponds to a desired filling level of a container (4) into which the spout (2) is inserted.

4. A funnel according to claim 1, wherein the constriction is defined by a bottom member (11) mounted in the flow-receiving part (1) and having a flow restricting opening (8) which can be closed by the float (5) so as to close the funnel.

5. A funnel according to claim 4, further comprising an operating rod (6) connected to the float (5) and extending up through said flow restricting opening (8), wherein the spring (9) is fitted around said rod.

6. A funnel according to claim 4, wherein one of the bottom member (11) and an upper part of the float (5) comprises said permanent magnet (10), and another of the bottom member and the upper part of the float comprises a body of magnetically attractable material.

7. A funnel according to claim 1, wherein the float has the form of an elongated cylinder (5) having an open bottom.

8. A funnel according to claim 7, wherein the float (5) has a circular cross-sectional shape; and one of an outer wall of the float and an inner wall of the spout (2) is provided with float-guiding projections (16).

9. A funnel according to claim 1, wherein the float has a polygonal (17) cross-section; and the float is guided by contact with an inner wall of the spout (2).

10. A funnel according to claim 1, further comprising stop means (18; 20, 21) for restricting a depth to which the spout (2) can be inserted into a container (4).

* * * * *